US006293694B1

(12) United States Patent
Mesing

(10) Patent No.: US 6,293,694 B1
(45) Date of Patent: Sep. 25, 2001

(54) FLOW PROMOTING MATERIAL HANDLING CONVEYANCE CONSTRUCTION

(75) Inventor: Ronald A. Mesing, Finleyville, PA (US)

(73) Assignee: Poly Hi Solidur Inc., Fort Wayne, IN (US)

( * ) Notice: Subject to any disclaimer, the term of this patent is extended or adjusted under 35 U.S.C. 154(b) by 0 days.

(21) Appl. No.: 09/260,762

(22) Filed: Mar. 2, 1999

Related U.S. Application Data

(60) Provisional application No. 60/077,020, filed on Mar. 6, 1998.

(51) Int. Cl.[7] ..... B01F 7/04

(52) U.S. Cl. ..... 366/343

(58) Field of Search ..... 366/325.1, 325.92, 366/330.1, 342, 343; 198/713, 714, 307.1, 308.1; 294/56; 15/93.1, 236.01

(56) References Cited

U.S. PATENT DOCUMENTS

| | | | | |
|---|---|---|---|---|
| 1,393,683 | * | 10/1921 | Hapner . | |
| 3,690,925 | | 9/1972 | Morris | 117/76 T |
| 3,979,549 | | 9/1976 | Wilkinson | 428/450 |
| 4,007,298 | | 2/1977 | Feehan et al. | 427/195 |
| 4,248,466 | * | 2/1981 | Carper . | |
| 4,307,133 | | 12/1981 | Haselier | 427/195 |
| 4,513,917 | * | 4/1985 | Szkaradek . | |
| 4,596,734 | | 6/1986 | Kramer | 428/213 |
| 4,923,550 | | 5/1990 | Kramer | 156/242 |
| 5,030,011 | | 7/1991 | Kronberg | 366/279 |
| 5,039,151 | * | 8/1991 | Davis . | |
| 5,109,976 | * | 5/1992 | Mohri et al. . | |
| 5,123,814 | | 6/1992 | Burdick et al. | 416/224 |
| 5,261,170 | * | 11/1993 | Ward . | |
| 5,344,235 | | 9/1994 | Weetman | 366/270 |
| 5,393,139 | * | 2/1995 | Thorson et al. . | |
| 5,580,170 | * | 12/1996 | Holley et al. . | |
| 5,797,477 | * | 8/1998 | Veenhof . | |

* cited by examiner

*Primary Examiner*—Tony G. Soohoo
(74) *Attorney, Agent, or Firm*—Quarles & Brady LLP

(57) ABSTRACT

An abrasion resistant material is combined with a flow promoting material to provide a conveyance that is flow promoting and wear resistant. Holes formed in a UHMW conveyance allow a ceramic overlay to bond to itself creating a mechanical bond with the UHMW. In a first embodiment, a ceramic composite overlay is form fit to UHMW mixing paddle. The paddle has a tongue with holes therethrough. The ceramic overlay fills the holes creating a mechanical bond between the paddle and the ceramic composite. In another embodiment, a ceramic overlay is bonded to a steel insert received in a channel formed in the distal end of a mixing paddle.

13 Claims, 3 Drawing Sheets

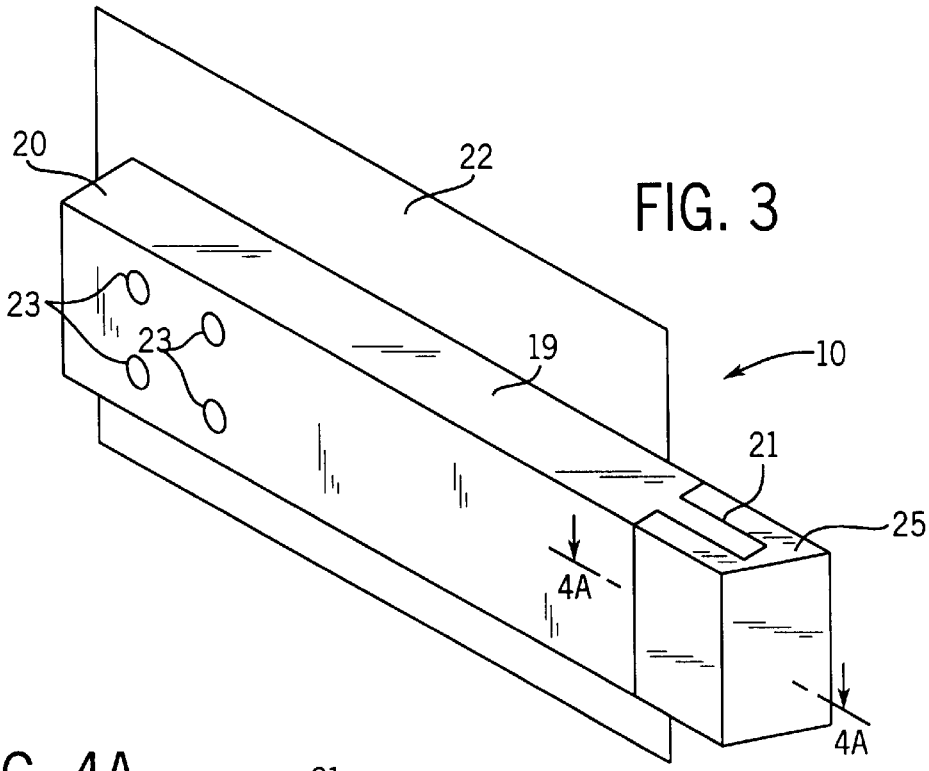
FIG. 3
FIG. 4A
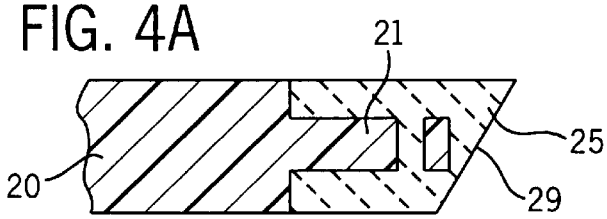
FIG. 4B
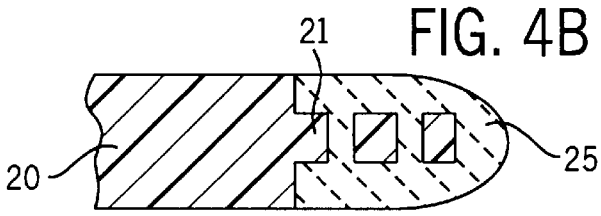
FIG. 5B
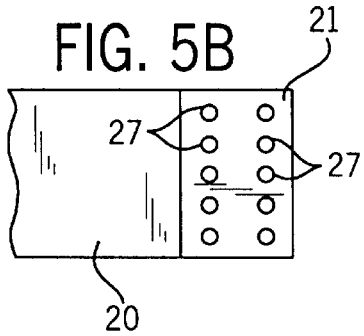
FIG. 5A
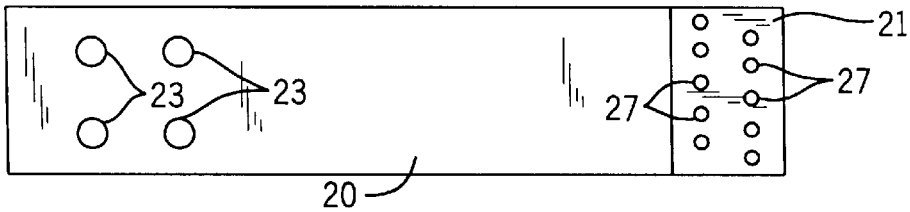

FLOW PROMOTING MATERIAL HANDLING CONVEYANCE CONSTRUCTION

CROSS REFERENCES TO RELATED APPLICATIONS

This application claims benefit of provisional application 60/077,020 filed Mar. 6, 1998.

BACKGROUND OF THE INVENTION

The field of invention is flow promoting material handling conveyances, such as paddles and buckets, and particularly such conveyances which are for handling abrasive fluid (including dry or wet semi-fluid) materials.

Highly abrasive materials which need to be mixed, moved or otherwise handled are encountered in many industries, such as paper and pulp mills and power utilities. These industries engage in transporting and processing highly abrasive materials such as fly ash and wood pulp.

Fly ash is a combustion byproduct from solid fuels, such as coal. The fly ash is an abrasive fine particulate that has multiple commercial uses, but becomes an airborne pollutant if not handled properly. In paper and pulp mills, wood in the form of trees is reduced to a wood pulp that is very abrasive.

Processing the fly ash and wood pulp requires mixing and conveying the highly abrasive material using various means and methods. A known mixing apparatus, such as a pug mill, reduces a coarse substance, such as fly ash, into a pulp. The pugmills mix the fly ash with water to create a pulpy fluid. These mills commonly use mixing paddles to continuously mix and urge the fluid along the length of the pug mill toward an unloading position. Other known methods to convey fly ash or other abrasive materials incorporate buckets mounted on a continuous conveying belt or chain mechanism. The buckets scoop up the abrasive material and dump it at a destination prior to returning for another load.

The highly abrasive fly ash and wood pulp wears away the paddle and bucket material requiring frequent replacement. In addition to the highly abrasive characteristics of the fly ash and wood pulp, the material tends to stick to conventional paddles and buckets reducing their efficiency.

Known paddles and buckets are made of hardened steel which is abrasion resistant. In abrasive environments, such as pugmills and pugmill unloaders handling fly ash, abrasion resistant overlays can be applied to the steel paddles. These paddles are wear resistant, but material sticks to their surfaces, making cleaning difficult.

In order to resolve the sticking problem, paddles and buckets composed of flow promoting materials such as, Ultra High Molecular Weight—Polyethylene (UHMW), nylon, and urethane, have been developed. These materials have a low coefficient of friction which is flow promoting, but at a cost of reduced abrasion resistance. The ends of the paddles or walls moving through the abrasive material constantly wear away requiring paddle replacement.

Conventional methods of bonding abrasion resistant materials to UHMW have been unsuccessful because of the flow promoting properties of the UHMW. In addition, the difference in expansion and contraction characteristics of the UHMW and abrasion resistant materials renders conventional adhesive means unavailable.

BRIEF SUMMARY OF THE INVENTION

The present invention provides an improvement to a conveyance construction for mixing a flowable abrasive material. The improvement includes a conveyance having a base with a surface made of a flow promoting material for contacting the abrasive material, and an edge. The edge is defined by an abrasion resistant material which is secured to the flow promoting material.

A general objective of the present invention is to provide an improved flow promoting construction for a fluid conveyance such as a mixing paddle or conveyor bucket. This objective is accomplished by securing an abrasion resistant material to an edge of a flow promoting material to provide a conveyance that is flow promoting and wear resistant.

In one useful form, the invention provides a flow promoting conveyance with a moldable ceramic composite fixed to a leading edge of the paddle or bucket. An abrasion resistant ceramic overlay is form fit to the leading edge of the flow promoting conveyance to provide a nonsticking wear resistant conveyance. Holes formed in a tongue portion of the conveyance at its leading edge allow the ceramic composite to bond to itself, creating a form fit mechanical joint with the body portion of the conveyance.

In another useful form, the invention provides a flow promoting conveyance with replaceable abrasion resistant edges. This is accomplished by overlaying a ceramic onto a steel insert which is mechanically attached to the leading edge of a conveyance with flow promoting surfaces.

The foregoing and other objects and advantages of the invention will appear from the following description. In the description, reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

BRIEF DESCRIPTION OF THE DRAWINGS

FIG. 3 is a perspective view of a first embodiment of the mixing paddle shown in FIG. 1;

FIG. 4A is a fragmentary sectional view along line 4—4 of a first embodiment of the mixing paddle shown in FIG. 3;

FIG. 4B is a fragmentary sectional view along line 4—4 of a second embodiment of the mixing paddle shown in FIG. 3.

FIG. 5A is a plan view of a base of the paddle of FIG. 4A which is the paddle without the abrasion resistant overlay;

FIG. 5B is a fragmentary plan view of a base for the paddle of FIG. 4B;

DETAILED DESCRIPTION OF THE PREFERRED EMBODIMENTS

Figure 1:
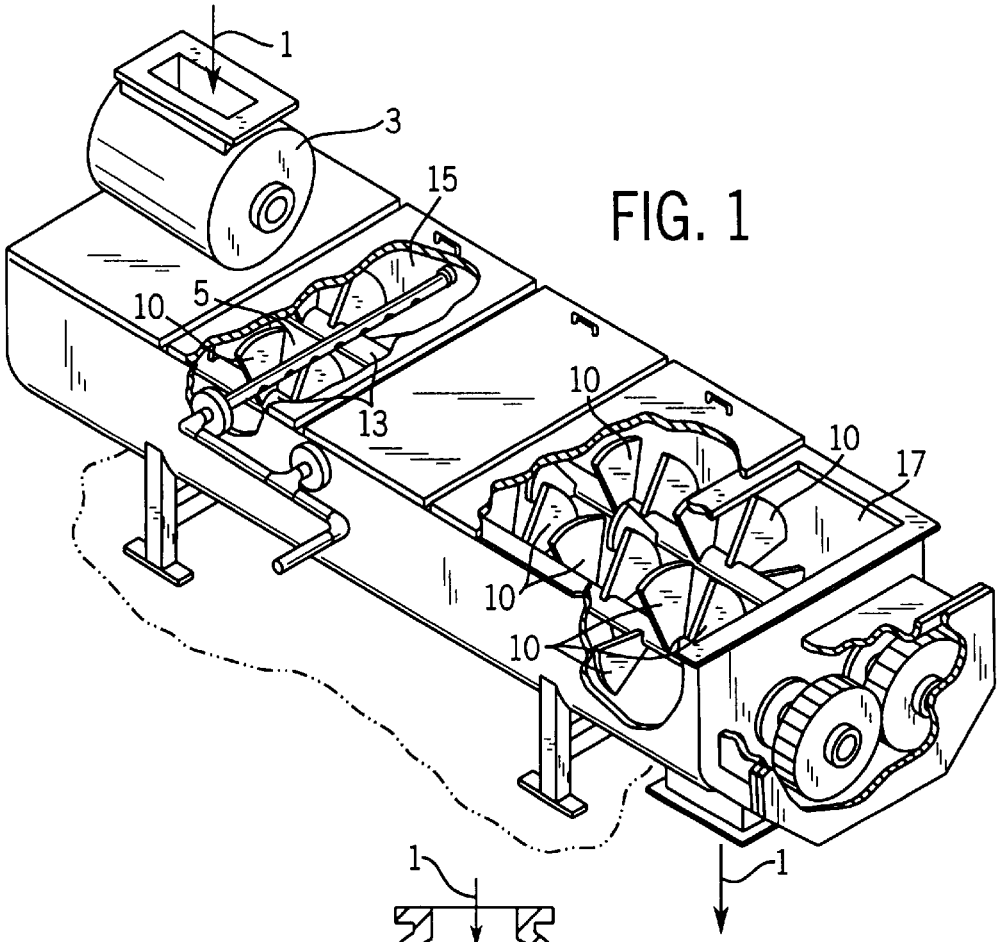
FIG. 1 is a side sectional schematic view of a fly ash mixer conditioner/unloader having mixing paddles of the present invention.
Figure 2:
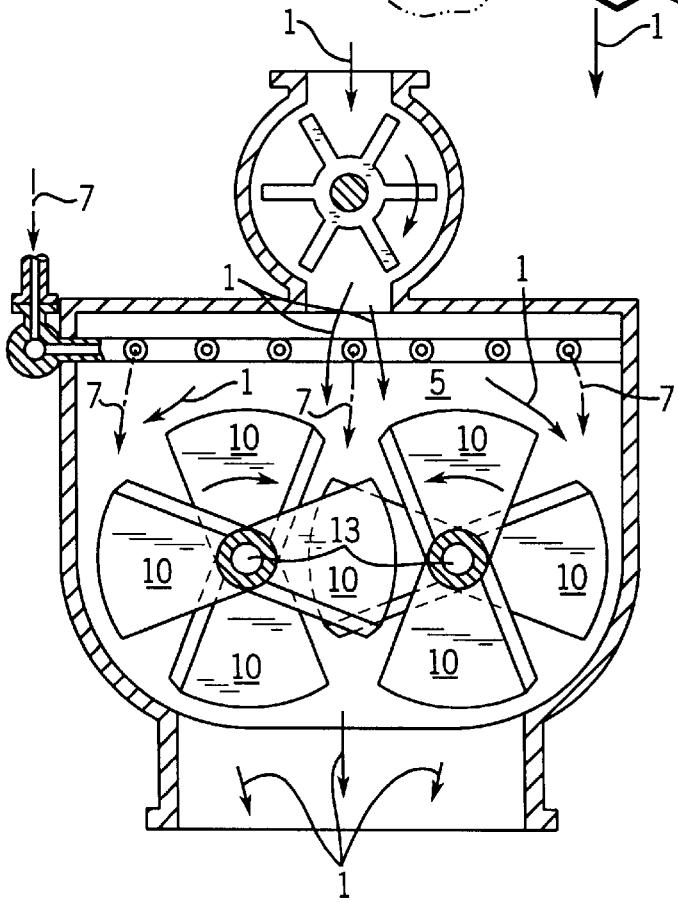
FIG. 2 is an end sectional schematic view of the fly ash mixer conditioner/unloader of FIG. 1.

In a known fly ash handling apparatus, shown in FIGS. 1 and 2, dry fly ash 1 enters a rotary feeder 3 that meters the fly ash 1 into a mixing chamber 5. Water 7 is sprayed onto the ash 1 as it is mixed by mixing paddles 10 rotating on a pair of shafts 13. The inclined mixing paddles 10 knead the wetted ash 1 while pushing the highly abrasive wet material from the inlet area 15 to the outlet end 17 of the chamber 5. In this apparatus, the leading or distal edge of the paddles, that is the edge furthest away from the shaft on which the paddle is mounted, experiences the most wear.

A first embodiment of the invention as shown in FIG. 3 is a mixing paddle 10 for pug mills which includes an abrasion resistant overlay 25 fixed to a base 19 at the leading edge of the paddle 10. The base 19 is composed of a flow promoting material, such as TIVAR 88-2, an Ultra High Molecular Weight (UHMW)-polyethylene material available from Poly Hi Solidur, Inc., Delmont, Pa., a a subsidiary of Menasha Corporation. The base 19 is substantially rectangular, and is formed by injection molding or other suitable plastic forming methods known in the art. Although the base 19 and paddle 10 as shown and described are rectangular, any shaped paddle, such as a fan shape, may incorporate the present invention to protect the portion of the paddle experiencing the most wear.

The flow promoting material of the base 19 prevents the wet abrasive fluid material from sticking to the majority of the paddle surfaces. The base 19 is formed, either by molding or machining, to have a body portion 20, and reduced thickness tongue portion 21 at the leading edge of the paddle 10. Holes 23 are formed through the body portion to permit bolting or otherwise attaching the paddle 10 to the rotating shaft.

The tongue 21 is integrally formed into the base 19 distal end providing an attachment point for the abrasion resistant overlay 25. At least one, and preferably multiple, holes 27 are formed in the tongue 21 providing a mechanism for the overlay 25 to bond with the UHMW base 19. Although circular holes are described herein, any mechanically locking shape, such as slots or dovetails may be used to bond the abrasion resistant material to the flow promoting material. The rows of holes 27 may be staggered as shown in FIGS. 4A and 5A, or in-line as shown in FIGS. 4B and 5B.

A putty like abrasion resistant composite material 25 is form fit to the tongue end of the base 19. In the first embodiment shown in FIGS. 3 and 4A, the material 25 is a two part polymer epoxy mix containing alumina and silicon, such as HUDCO 5000 available from Hudco Industrial Products, Inc. of Bessmer, Ala., BELZONA 1811 Ceramic Carbide commercially available from Belzona Western Ltd. of Calgary, Alberta, Canada, and WearPak 700 available from Norton Pakco Industrial Ceramics of Latrobe, Pa. Other abrasion resistant materials not containing alumina and silicon may be used. The wear resistant ceramic composite 25 increases the useful life of the paddle 10 by protecting the paddle tip which is subjected to the greatest erosive conditions.

The composite parts are mixed and then form fit to the paddle 19 filling the holes 27 in the tongue 21. Curing occurs 30 to 40 minutes after mixing. The composite 25 can be form fit to the paddle 10 by overmolding or simply troweling the composite 25 onto the UHMW paddle 19 and tongue 21. It is very important that the tongue holes 27, or other locking shape are filled by the ceramic composite 25 allowing the composite 25 to bond to itself creating a mechanical joint with the UHMW paddle. A chamfer 29 may be cut into the ceramic composite as shown in FIG. 4A, by sawing, grinding or other methods known in the art to provide an efficient mixing shape, or the trowel method may be used to produce a rounded shape as shown in FIG. 4B.

A chemical bond between the base 19 and the material 25 may also develop depending upon the composition of the material 25. In environments that experience significant temperature variations, however, this chemical bond may break due to a disparity between the expansion coefficients of the UHMW and ceramic composition. In one example that did not incorporate the present invention, a paddle with a ceramic composite overlay vacuum bonded to the tip was subjected to freezing temperatures and then allowed to reach room temperature. After repeating this temperature cycle once, the ceramic composition broke away from the UHMW with minimal force.

Figure 6:
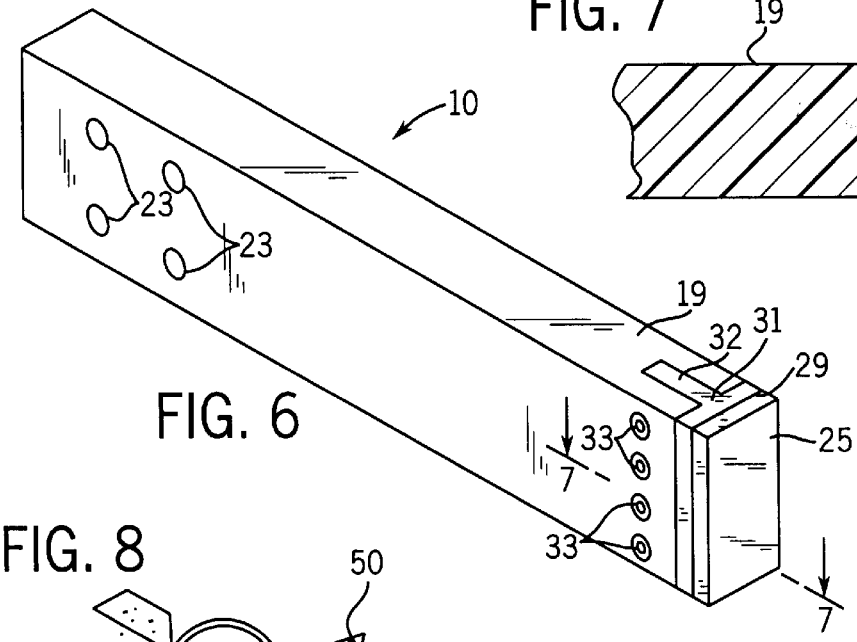
FIG. 6 is a perspective view of a third embodiment of a mixing paddle incorporating the invention.
Figure 7:
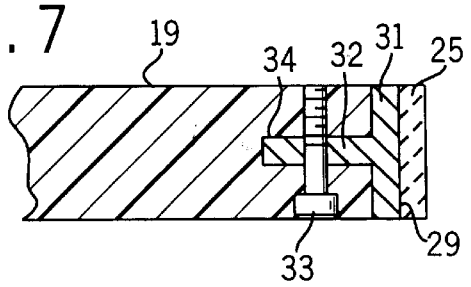
FIG. 7 is a sectional view along line 7—7 of FIG. 6.

A second embodiment of the invention, shown in FIGS. 6 and 7, incorporates the invention by bonding ceramic plate 25 to a steel insert 31, and mechanically securing the steel insert to the base 19 of the paddle 10. A ceramic overlay 25 is vacuum bonded to the top of the flange 29. A T-shaped ceramic plated insert 31 is commercially available from Norton Pakco Industrial Ceramics of Latrobe, Pa.

The rib 32 of the insert 31 is received in a channel 34 formed in the distal end of the UHMW base 19. Bolts 33 through the base 19 and rib 32 secure the insert 31 to the base 19. Although bolts are shown in FIGS. 6 and 7, screws, rivets or the like may be used to secure the insert 31 to the base 19. The ceramic plate 25 vacuum bonded to the steel insert 31, provides a replaceable abrasion resistant tip on the paddle 10.

One variation of the above embodiment provides a rib 32 that is substantially the length of the base 19. The rib stiffens the paddle 10 for use in a dense slurry.

Still another embodiment provides a paddle with an abrasion resistant edge as described herein having a base formed from a steel stiffener with flow promoting material cladding. In one embodiment, a ⅛" cavity is milled into the interior surface of each of two paddle halves that form the cladding for the steel stiffener. The paddle halves are symmetrical about a plane 22 shown in FIG. 3. A ¼" steel plate is interposed between the two halves. The steel plate and cavity may extend past the holes shown in FIG. 3, in which case holes for mounting that correspond to holes 23 as shown in FIG. 3 are formed in the steel plate. Preferably, however, the steel plate and cavity, formed in the paddle halves, do not extend past the holes 23, thus preventing fly ash or other material from entering the cavity when in use.

The flow promoting material halves encapsulate the steel plate and are joined together by extrusion welding, bolting or other methods known in the art. The edges of the paddle halves may be beveled to provide additional surface area for the extrusion welding or other joining methods. An abrasion resistant edge is then combined with the stiffened paddle body as disclosed above. Although dimensions are shown for illustration purposes, the paddle and stiffener can be larger or smaller than described herein to practice the invention.

The invention as disclosed is not limited to paddles used for mixing and conveying abrasive materials. Other conveyances, such as elevator buckets, scrapers and the like, that are subjected to abrasive material may also incorporate the present invention. In a third embodiment, an bucket elevator conveying system as shown in FIG. 8 incorporates the present invention into a UHMW elevator bucket.

Figure 8:
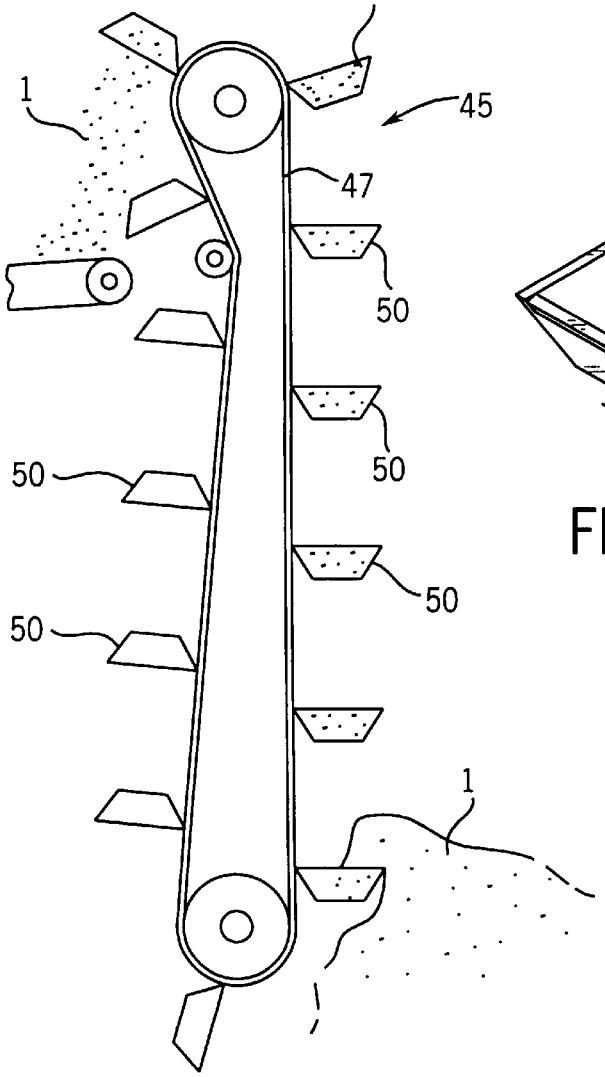
FIG. 8 is a view of a bucket elevator with buckets incorporating the present invention.
Figure 9:
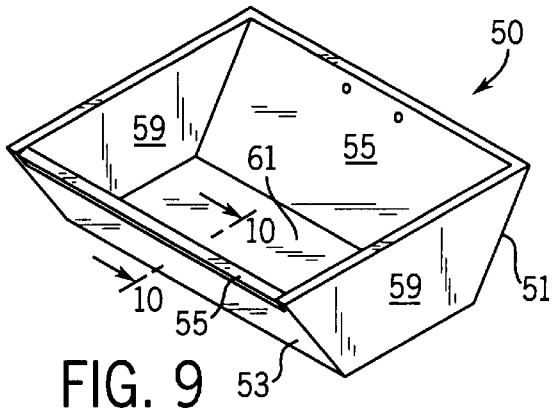
FIG. 9 is a perspective view of a bucket for the elevator of FIG. 8.
Figure 10:
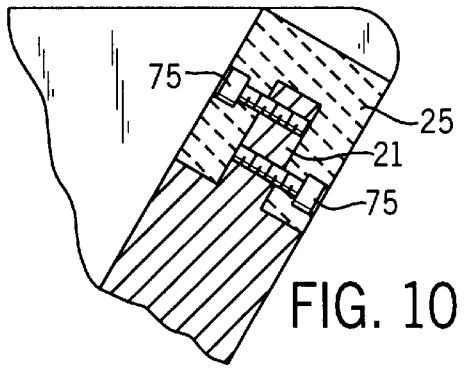
FIG. 10 is an embodiment of the present invention incorporating screws.

A known bucket elevator 45, as shown in FIGS. 8–10, is composed of a continuous conveying mechanism 47, such as a conveyor belt or chain, with buckets 50 mounted thereon. The conveyor mechanism 47 is a continuous loop driven by conventional methods known in the art. As the buckets 50 travel along the loop it scoops up material 1, such as fluidized fly ash, for conveying. When the bucket 50 reaches an end of the loop, its contents are dumped and the empty bucket 50 returns to scoop up another load.

As shown in FIG. 9, the bucket 50 has a single piece UHMW box shaped base 51 having a front wall 53 with a lip 55, a rear wall 57, two side walls 59 and a bottom 61. The rear wall 57 is mounted to the conveying mechanism 47. As the bucket 50 scoops up the abrasive material 1, the lip 55, as in the leading edge 25 in the embodiments described above, is subjected to the most wear. The bucket lip 55 may therefore be of the same construction as the leading edge of the aforementioned paddle 10, i.e. the construction of FIGS. 4A, 4B, or FIG. 7.

Finally, in any of the embodiments of FIGS. 4A and 4B, the abrasion resistant material 25 may be affixed to the tongue 21 by screws, bolts, or the like. As shown in FIG. 10, screws 75 may be screwed through the overlay 25 directly into the tongue 21 to provide a mechanical bond between the base and overlay materials. This attachment means can be used alone or in conjunction with the holes illustrated in FIGS. 4A and 4B to provide an additional mechanical bond to further reduce the potential for separation between the two materials.

Thus the invention provides composite material for a flow promoting conveyance moving through an abrasive material comprising a flow promoting material, such as UHMW, and an abrasion resistant material, such as a ceramic composite, form fit to the flow promoting material.

The invention further provides a flow promoting material having a tongue integrally formed part of the flow promoting material with a one or more holes, or other interlocking shape, such as a slot or dovetail therein. Upon application of the abrasion resistant material to the tongue, the abrasion resistant material fills the locking shape creating a mechanical bond with the flow promoting material. The abrasion resistant material can be further secured by screws.

Even further, the invention provides a flow promoting conveyance with a replaceable abrasion resistant edge. In one example, a mixing paddle base has a channel formed in the distal end of the base in which a T-shaped metal insert with an abrasion resistant overlay is mounted.

Yet even further, the invention provides a bucket formed from a flow promoting material with an abrasion resistant lip for conveying abrasive materials.

While there has been shown and described what are at present considered the preferred embodiment of the invention, it will be obvious to those skilled in the art that various changes and modifications can be made therein without departing from the scope of the invention. One such example is a paddle with an abrasion resistant edge as described herein having a base formed from a flow promoting material having a cavity in which a steel stiffener is inserted.

I claim:

1. A mixing paddle suitable for mixing an abrasive material, said paddle comprising:

a base having at least one edge, and being fixable to a mixing mechanism which urges the paddle through the abrasive material;

an interlocking shape formed in said base proximal said edge; and a protective material applied to said interlocking shape, whereby application of said protective material to said interlocking shape creates a mechanical bond between said protective material and said base, and said protective material is engagable with the abrasive material being mixed when said base is fixed to the mixing mechanism, wherein said base is Ultra High Molecular Weight-polyethylene.

2. The paddle of claim 1, in which said protective material wraps around said edge and extends into said interlocking shape.

3. The paddle of claim 1, in which said protective material extends into said interlocking shape from opposing surfaces of said base, and bonds to itself to mechanically bond said protective material to said base.

4. The paddle of claim 1, in which said protective material comprises a ceramic material.

5. The paddle of claim 1, including fasteners which fix said protective material to said base.

6. The paddle of claim 1, wherein said interlocking shape is selected from the group consisting of holes, slots, and dovetails.

7. The paddle of claim 1, wherein said base includes a stiffener.

8. The paddle of claim 7, wherein said stiffener is enclosed by said base.

9. A mixing paddle suitable form mixing an abrasive material, said paddle comprising:

a base having at least one edge, and being fixable to a mixing mechanism which urges the paddle through the abrasive material;

an insert detachably secured to said base; and a protective material fixed to said insert, wherein said protective material is engagable with the abrasive material being mixed when said base is fixed to the mixing mechanism, wherein said base is Ultra High Molecular Weight-polyethylene.

10. The paddle of claim 9, wherein said insert reinforces said base.

11. The paddle of claim 9, in which said protective material comprises a ceramic material.

12. The paddle of claim 9, wherein said base includes a stiffener.

13. The paddle of claim 12, wherein said stiffener is enclosed by said base.

* * * * *